United States Patent [19]

Perch

[11] 4,264,414

[45] Apr. 28, 1981

[54] METHOD FOR REDUCING COKE OVEN CARBONIZATION PRESSURE

[75] Inventor: Michael Perch, Pittsburgh, Pa.

[73] Assignee: Koppers Company, Inc., Pittsburgh, Pa.

[21] Appl. No.: 65,470

[22] Filed: Aug. 10, 1979

[51] Int. Cl.[3] ..... C10B 53/00; C10B 53/08

[52] U.S. Cl. ..... 201/21; 201/2.5; 201/20; 201/40; 201/42

[58] Field of Search ..... 201/2.5, 6, 20, 21, 201/23, 24, 40, 42

[56] References Cited

U.S. PATENT DOCUMENTS

| | | | |
|---|---|---|---|
| 1,030,333 | 6/1912 | Rusby | 201/24 X |
| 1,358,664 | 11/1920 | Wallace | 201/40 X |
| 1,593,208 | 7/1926 | Culmer | 201/21 |
| 2,504,150 | 4/1950 | Perch | 201/40 |
| 2,885,327 | 5/1959 | Yavorsky | 201/40 X |

FOREIGN PATENT DOCUMENTS

| | | | |
|---|---|---|---|
| 499432 | 1/1939 | United Kingdom | 201/21 |

*Primary Examiner*—Frank W. Lutter
*Assistant Examiner*—Roger F. Phillips
*Attorney, Agent, or Firm*—Donald M. MacKay; Oscar B. Brumback; Herbert J. Zeh

[57] ABSTRACT

A method of reducing the carbonization pressure in the coking of coal is provided which comprises randomly dispersing flakes through the coal, said flakes formed of a material that does not pass through a plastic phase such as pressed sawdust wherein the flakes have a thickness of between about $\frac{1}{8}''$ and about $\frac{3}{4}''$ and a length and width of between about 1" and about 5".

4 Claims, 1 Drawing Figure

EFFECT OF ADDITION OF SAWDUST FLAKES ON CARBONIZATION PRESSURE

EFFECT OF ADDITION OF SAWDUST FLAKES ON CARBONIZATION PRESSURE
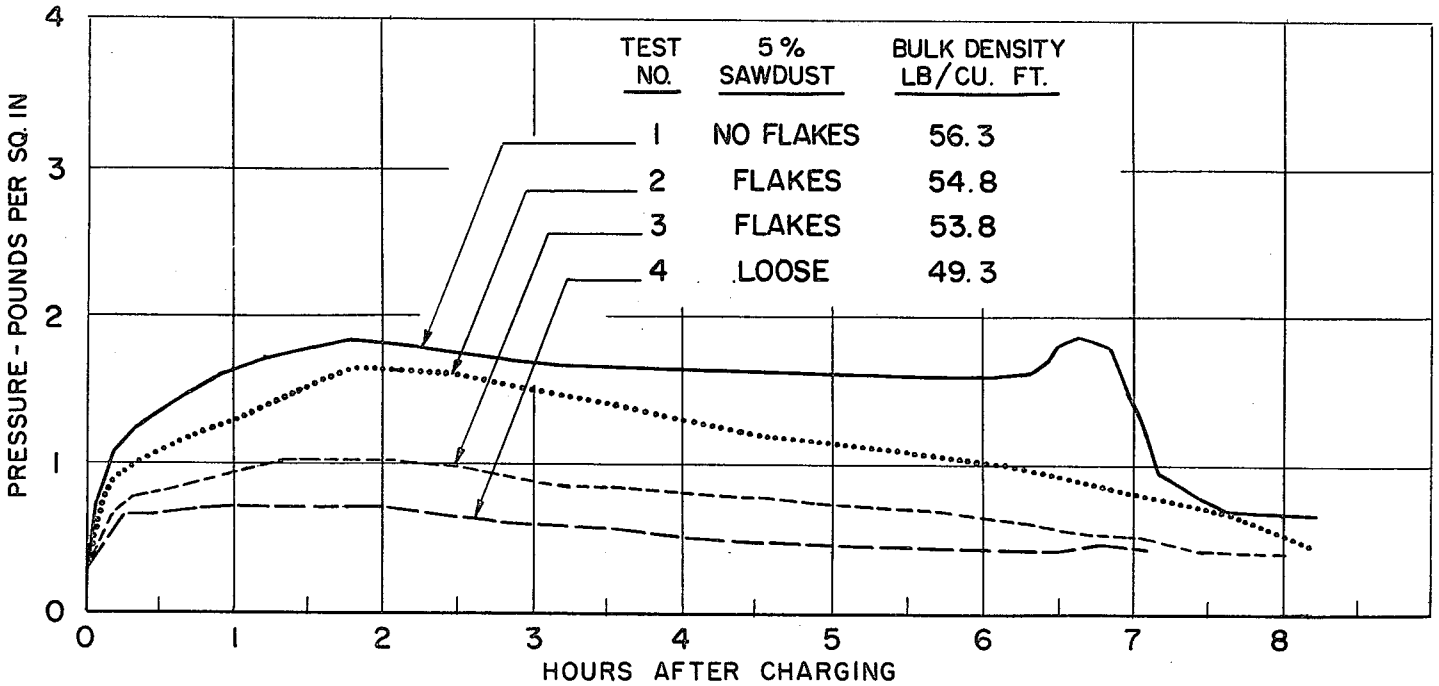

METHOD FOR REDUCING COKE OVEN CARBONIZATION PRESSURE

BACKGROUND OF THE INVENTION

When coal is carbonized it first softens and, at or near the temperature of softening, decomposition begins. As the temperature increases, the coal becomes more and more fluid and the rate of decomposition also increases. It is thus evident that gaseous decomposition products are being formed in a fluid mass. The degree of fluidity of this system together with the rate of formation of the gaseous products determines in large measure the amount of pressure that is exerted against the walls that confine the coal. This system is one of the sources of the pressure. There are two conditions, however, that act to relieve the pressure.

These conditions are: (a) the void spaces between the coal particles, and (b) the shrinkage of the newly-formed coke as the temperature of the mass increases. The former is inversely related to the bulk density of the mass of coal particles; for, the more void spaces present, or the lower the bulk density, the more readily can the softening particles of coal expand into the void spaces.

There is another source of pressure that is also due to the formation of gases but the mechanism is somewhat different. It is related not only to the rank of the coal and its consequent fluid properties but it is also related to the coke oven itself. In a coke oven two plastic seams parallel to the oven walls are established soon after the coal is charged and these progress toward the center of the oven as carbonization proceeds. Because there is considerable heat stored in the roof, floors, and doors, plastic seams are also started from these surfaces and progress away from them at a rate proportional to the heat available. In other words, there is a continuous plastic envelope around the uncarbonized coal from soon after the time the coal is charged until the two plastic seams starting from the walls, meet at the center of the oven. Gases evolved into the raw coal side of the plastic seams are therefore entrapped within the plastic envelope. At or near the end of the carbonization period or when the two plastic seams are about to meet at the center of the oven, with the envelope still entrapping the gas, the rate of heating increases sharply thus increasing the amount of gas evolved with the net result that the pressure rises rapidly. As soon as the two plastic seams have met and solidified into coke, a rapid decrease in pressure occurs due to the disappearance of the envelope. While sawdust has been previously found to reduce carbonization pressure (C. C. Russell, M. Perch, J. F. Farnsworth, Reducing Coal-Expansion Pressure, AIME Proc. Blast Furnace, Coke Oven, Raw Materials Conference, 8, 32–50 (1949), the mechanism has been by the reduction of coal bulk density which is known can be reduced by several means including moisture addition and finer pulverization.

As shown in FIG. 7 of the above publication, loose sawdust did not eliminate the pressure peak near the end of the coking period with 4 and 6% sawdust addition, and it was only with 8% addition, and a substantial decrease in bulk density to 41.3 lbs. per cu. ft. where the peak disappeared. The lowering of bulk density means loss in coke oven productivity as well as serious effect on coke strength.

Sawdust and other materials in the form of flakes however, straddle the plastic seams in the oven charge to provide the necessary passage for the gas and disruption of the plastic envelope without necessarily decreasing the bulk density, oven productivity, nor affecting the properties of the resultant coke as is the case with loose sawdust addition.

BRIEF DESCRIPTION OF THE DRAWING

The drawing is a graph depicting the effect of flake addition on carbonization pressure.

BRIEF DESCRIPTION OF THE INVENTION

It has now been discovered that the carbonization pressure generated by the coal charge can be reduced in a coke oven with other advantages achieved, by randomly dispersing flakes through the coal charge, the flakes formed of a material that does not pass through a plastic phase, so as to provide gas passage ways across the plastic coal seams. What is meant by a material passing through a plastic phase is that the material forms a sheet like plastic which traps the carbonization gases.

DETAILED DESCRIPTION OF THE INVENTION

Among the materials which can be employed as flakes to reduce the carbonization pressure generated by the coal charge are sawdust, paper pulp, newspapers, solid municipal and agricultural wastes and other similar materials which do not pass through a plastic phase. Typical flakes have a thickness of ¾" and are up to 3 to 5 inches in length and breadth. Suitable flakes, however, may have a thickness of from about ⅛" to about ¾" and a length and breadth of from about 1" to 5".

The amount of flakes employed will depend upon the material and the type of coal employed, but generally will be from between about 2% and about 8% or more by weight of the mixture.

The following examples will serve to illustrate the invention. All parts and percentages in said examples and elsewhere in the specification and claims are by weight unless otherwise specified.

EXAMPLES

Sawdust flakes without a binder were made from up to ¾" in thickness and up to 3 to 5 inches in length and breadth. Tests were made in a movable-wall oven with air-dried coal and an average flue temperature of about 2450° F. using a coal mixture of 70% Pittsburgh seam plus 30% Beckley seam. One test was made with no sawdust addition while the other three were made with 5% sawdust addition, two with flakes and one with loose unflaked sawdust. The results are shown in Tables I and II.

TABLE I

Effect of Addition of Sawdust Flakes on Carbonization Pressure
70% Pittsburgh and 30% Beckley

| Test No. | 1 | 2 | 3 | 4 |
|---|---|---|---|---|
| Addition | None | 5% sawdust flakes | 5% sawdust flakes | 5% loose sawdust |
| Flake size | None | ¾" by 2–5" | ¾" by ¼–3" | 74%–⅛" |
| Moisture,% | 0.5 | 0.5 | 0.8 | 0.5 |
| Avg. Flue Temp., °F. | 2448 | 2441 | 2445 | 2443 |
| Bulk Density lb./cu.ft. | 56.3 | 54.8 | 53.8 | 49.3 |
| Max. Pressure lb./sq. in. | 1.83 a | 1.65 | 1.03 | 0.71 |
| Pressure at Time of Peak | | | | |

TABLE I-continued

| Effect of Addition of Sawdust Flakes on Carbonization Pressure 70% Pittsburgh and 30% Beckley | | | | |
|---|---|---|---|---|
| Test No. | 1 | 2 | 3 | 4 |
| lb./sq.in. | 1.83 | 0.88 | 0.55 | 0.45 |

a Occurred as peak pressure near end of test; others were prepeak pressures occuring early in the test.

TABLE II

| Effect of Addition of Sawdust Flakes on Coke Properties of 70% Pittsburgh and 30% Beckley | | | | |
|---|---|---|---|---|
| Test No. | 1 | 2 | 3 | 4 |
| Addition | None | 5% sawdust flakes | 5% sawdust flakes | 5% loose sawdust |
| Flakes size | None | ¾" by 2-5" | ¾" by ¼-3" | 75%-⅛" |
| Coke Size [ASTM D293 Procedure) | | | | |
| % on 4" | 7.1 | 7.5 | 5.2 | 11.9 |
| % on 3" | 23.9 | 15.5 | 25.1 | 25.6 |
| % on 2" | 47.3 | 46.9 | 44.9 | 39.6 |
| Total on 2" | 78.3 | 69.9 | 75.2 | 77.1 |
| % on 1½" | 16.2 | 22.5 | 17.0 | 17.1 |
| % on 1" | 2.8 | 3.3 | 4.3 | 3.2 |
| % on ½" | 1.3 | 1.9 | 1.7 | 1.2 |
| % Minus ½" | 1.4 | 2.4 | 1.8 | 1.4 |
| Coke Shatter Test [ASTM D3038 Procedure) | | | | |
| % on 3" | 7.2 | 6.8 | 9.0 | 10.0 |
| % on 2" | 48.8 | 46.2 | 46.4 | 47.8 |
| Total on 2" | 56.0 | 53.0 | 53.4 | 57.8 |
| % on 1½" | 29.6 | 31.8 | 29.8 | 27.8 |
| % on 1" | 8.0 | 10.0 | 9.4 | 8.4 |
| % on ½" | 2.8 | 2.2 | 2.4 | 2.6 |
| % on Minus ½" | 3.6 | 3.0 | 3.0 | 3.4 |
| ASTM Tumbler Test [ASTM D3402 Procedure) | | | | |
| Stability Factor | 50.6 | 51.3 | 47.4 | 48.2 |
| Hardness Factor | 67.4 | 65.9 | 65.7 | 63.5 |
| Modified Tumbler Test (2" by 1" coke tumbler in an ASTM coke tumbler for 700 revolutions | | | | |
| Modified Stability | 63.4 | 63.3 | 61.8 | 58.4 |
| Modified Hardness | 78.8 | 77.9 | 77.4 | 76.8 |
| ASTM D167 Procedure | | | | |
| Apparent Spec Gravity | 0.842 | 0.802 | 0.820 | 0.772 |

In Table I the data shows that the pressure peak is reduced with the flake addition without any significant reduction in bulk density of the coal.

In Table II the results are shown of the effect of sawdust addition on the properties of the coke. In general, it can be seen that the coarse flake addition had only a small effect on the properties of the coke. The smaller flakes increased the size of the coke somewhat and there was some decrease in the tumbler stability factor. The unflaked sawdust resulted in larger coke size and appreciably decreased stability and hardness factors.

In the drawing, the progress of pressures developed for each of the tests from start to finish is shown. It is to be noted that the presence of sawdust flakes was effective in reducing the pressure developed by the coal mixture. In all three tests with sawdust, the pressure peak near the end of the coking period was completely eliminated. This indicates that the plastic envelope, which existed in the blank test and resulted in a pressure peak, was disrupted by the presence of the sawdust flakes. Some reduction in pressure in the prepeak range was obtained from start to finish in all the sawdust tests compared to the blank run. This reduction in pressure, however, should be attributed to the reduction in the bulk density of the charge. The reduction in bulk density was small in the case of the flakes, but was somewhat more in the case of the loose sawdust.

When the examples are repeated employing flakes of paper and solid municipal and agricultural wastes similar results are obtained.

While the invention has been illustrated by preferred embodiments thereof it will be apparent to one of ordinary skill in the art that obvious modifications and variations can be made without departing from the true scope of the invention and accordingly the invention is to be limited only by the appended claims.

What is claimed:

1. A method of reducing the carbonization pressure in the coking of coal which comprises randomly dispersing flakes through coal and charging a coking oven with the coal, said flakes formed of a material that does not pass through a plastic phase, and coking the resulting mixture wherein said flakes provide gas passage ways across the plastic coke seams formed during the coking process, and wherein the flakes have a thickness of between about ⅛" and about ¾" and a length and width of between about 1" and about 5".

2. The method of claim 1 wherein the flakes are formed of sawdust.

3. The method of claim 1 wherein the quantity of flakes comprises from between about 2% and about 8% by weight of the total mixture.

4. The method of claim 1 wherein the flakes are formed of paper pulp, newspapers, solid municipal waste, agricultural wastes, or other similar carbonaceous materials that do not pass through a plastic phase.

* * * * *